United States Patent [19]

Hirai

[11] Patent Number: 4,737,431

[45] Date of Patent: Apr. 12, 1988

[54] NEGATIVE-ELECTRIFICATION FINELY-DIVIDED TONER IN USE FOR ELECTROPHOTOGRAPHY

[75] Inventor: Keisuke Hirai, Tokyo, Japan

[73] Assignee: Faco Corporation Ltd., Tokyo, Japan

[21] Appl. No.: 923,316

[22] Filed: Oct. 8, 1986

Related U.S. Application Data

[63] Continuation of Ser. No. 717,950, Mar. 29, 1985, abandoned.

[30] Foreign Application Priority Data

Aug. 29, 1984 [JP] Japan ..... 59-180149

[51] Int. Cl.[4] ..... G03G 9/08

[52] U.S. Cl. ..... 430/109; 430/110

[58] Field of Search ..... 430/106, 106.6, 108, 430/110, 126, 109

[56] References Cited

U.S. PATENT DOCUMENTS

| | | | |
|---|---|---|---|
| 2,297,691 | 4/1939 | Carlson . | |
| 4,513,074 | 4/1985 | Nash | 430/106.6 |
| 4,514,487 | 4/1985 | Kasuya et al. | 430/126 |
| 4,535,049 | 8/1985 | Honda et al. . | |

FOREIGN PATENT DOCUMENTS

| | | | |
|---|---|---|---|
| 42-23910 | 3/1970 | Japan . | |
| 43-24748 | 4/1980 | Japan . | |
| 12558 | 1/1985 | Japan | 430/108 |

*Primary Examiner*—John L. Goodrow

*Attorney, Agent, or Firm*—Stewart L. Gitler; Martin P. Hoffman; Mitchell B. Wasson

[57] ABSTRACT

Disclosed is a negative-electrification toner for use in electrophotography. The toner comprises a resin, essentially consisting of a solid silicon varnish, and a colorant so that the resultant latent image can be easily erased or eliminated by the use of a rubber eraser. The novel toner, essentially consisting of a solid silicon varnish, has a low softening point and, as a result, the latent image produced can be easily erased.

8 Claims, No Drawings

NEGATIVE-ELECTRIFICATION FINELY-DIVIDED TONER IN USE FOR ELECTROPHOTOGRAPHY

This is a continuation of application Ser. No. 717,950, filed Mar. 29, 1985, now abandoned.

FIELD OF THE INVENTION

The present invention relates to a negative-electrification finely-divided toner for use in developing a latent image formed by electrostatic photography, electrostatic recording or analogous technology. Particularly, it relates to a toner that produces an image or a pattern that can be easily eliminated or reduced by a rubber eraser.

DESCRIPTION OF THE PRIOR ART

The use of electrophotography is disclosed in U.S. Pat. No. 2,297,691 and Japanese Patent Publication Nos. 42-23910 and 43-24748.

There have been known some electrostatic recording techniques, one of which includes a cascade method wherein the positive electrified electrostatic latent image is developed by dispersing a mixture of toner powder and glass beads and some additive to the latent image on the photosensitive sheet; and another of which is a magnet brush developing method wherein a photosensitive body is rubbed with a mixture of toner and magnetic iron powder held on the magnet in the form of brush to develop the positive electrified electrostatic latent image. In those methods, the toner-developed image is transferred onto paper sheet or film base, and then fixed thereon by applying thermal treatment or solvent vapor to thereby melt or dissolve the toner transferred, followed by the fixation of the transferred image.

In the prior art, the fixed image cannot be easily erased nor eliminated by any touch, such as an operator's hand or other sheets piled thereon, and therefore, the prior art toner has a strong adhesive force to paper and a high coating strength of the fixed resultant image such that the coating of the fixed image is strong enough to resist the above-mentioned rubbing action, such as operator's touch or paper mutual rubbing. Therefore, the prior art fixed image cannot be easily erased nor eliminated by an ordinary rubber eraser.

As mentioned above, the objective of the prior art duplication methods is to produce a strong and durable copy image on the paper or film base. However, there is a need for partial correction or elimination of the fixed image for the production of an original for further duplication. In other words, it is desired in some cases to partially correct the fixed image copy. The second original can be easily produced by eliminating or removing the unnecessary image or pattern of the fixed copy and/or further adding the necessary pattern to the partially eliminated copy.

In the past, a solvent has been used to remove or eliminate the fixed copy image from the paper, because an ordinary rubber eraser cannot easily eliminate the fixed image as described before. When a solvent is used on ordinary paper, the pigment contained in the toner may dissolve and penetrate into the paper, resulting in a blot that can hardly be removed. Therefore, in the prior art, there is a limitation in the choice of solvents. In order words, only a drawing sheet or film base into which the selected solvent cannot penetrate can be used for this purpose. This is one of the shortcomings of the prior art toner.

In the past, in order to apply solvent to a copy paper to eliminate the toner image, a vessel saturated with solvent is used to put solvent on the image to be eliminated. For example, a felt-tipped pen is used to rub the image to be eliminated, thereby dissolving the coating of the fixed image and removing or wiping the remaining solvent with a rubber eraser and further, after completely drying, re-drawing a desired letter or figure on the location from which the image has been completely removed. Such procedure involves some technique, and needs some time, and further in the case of film base, some of the solvents may damage the surface of the base, thereby affecting significantly the drawing feature in correcting. Further, because the solvent contains some toxic volatile materials, much care must be taken by the operator to prevent the solvent from touching his body and clothing, limiting the locations at which the operator can correct the copy image.

Further, when the toner easily melts at a lower temperature, the toner is apt to be caked or conglomerated during use or storage. Particularly, toner having a melting point at a temperature lower than 100° C. has significantly less fluidity.

SUMMARY OF THE INVENTION

It is an object of the present invention to provide a negative-electrification finely-divided toner that can produce through PPC (plain paper copying) copying a fixed image which can be easily erased or eliminated by using a rubber eraser instead of solvent. Upon using the inventive toner, the clear and sharp image as fixed can be formed on the paper sheet by a PPC copying machine, which image can be easily erased or eliminated by a rubber eraser, and such elimination procedure does not harm the surface of the paper.

Therefore, the inventive toner has the characteristic in that when an image formed by the toner is rubbed by a rubber eraser to be eliminated, the image coating formed from the toner can be cut into fine particles or ground to be peeled off, and conveniently removed from the paper, together with the scrape of the rubber eraser. it is desired that the binding force of the coating of the toner image be lower than that of the coating to the paper.

DETAILED DESCRIPTION OF PREFERRED EMBODIMENTS

In accordance with the present invention, the novel toner provides such thermal characteristics of the produced coating that it can be softened or melted at the fixing temperature when used in a copying machine to stick thereby to the paper, and when it is cooled to room temperature, the produced coating of the fixed image does not stick to other paper or contacted matter. For example, when the fixing temperature used in the copying machine is at the range of 90° C. to 120° C., the softening temperature of the used toner should be around or at this range.

In order to gain such coating characteristics of the toner, the formulation of the toner must be reviewed. Generally, the toner will consist essentially of a colorant (pigment), a binding agent, and in addition, various auxiliary agents.

Most of the toners that are now being used have a very high softening temperature at about 100° C. to 180° C., and therefore, an excess quantity of thermal energy is necessary. As a result thereof, there are various limitations, for example, in selection of materials and thickness of the usable copying sheet, and various problems, such as that of sheet advancement in the copying machine.

In contrast, the inventive toner, as discussed, contains solid silicon varnish, with a molecular weight in the range of 500–4000, as an important component, and therefore, has a lower softening point at about 90° C. to 110° C. therefore, thinner film base (38 micrometers thick) can be used, and the range of the usable copying paper can be widened with less trouble of paper advancing movement in the copying machine.

In accordance with the present invention, the new toner can produce through the ordinary procedure in the common PPC copying machine a fixed image or pattern that can be easily erased or eliminated by an ordinary rubber eraser, in the same way as a pencil drawn pattern is easily erased by a rubber eraser. When one intends to make copies of drawings or general letters by partially correcting the original copy, one can make the second corrected original pattern for further copying by partially correcting a copy or pattern produced by copying of the first original, or eliminating only an unnecessary part of the copy or pattern produced by the duplication of the first original. For this purpose, the inventive toner is very effective in that the image or pattern produced from the new toner can be easily eliminated by the simple use of only a rubber eraser.

The inventive toner can be applied to all types of copying media available for a PPC copying machine, and a drawing paper and film base as well as ordinary paper having a smooth treated surface so that it has the surface characteristics of drawing paper, such as art paper, can be used, at which the image or pattern produced by the novel toner can be erased or eliminated by the simple use of only a rubber eraser.

The prior art toner contains as a major component resin having strong adhesive forces so that the fixed image cannot be easily eliminated. The toner contains further a colorant, an electrification-control agent, and auxiliary agents. The toner is produced by kneading a mixture of the above materials in a kneading machine with a heat roller, and milling followed by sieving to get the particles of 5 to 20 micrometers in size.

In contrast, the inventive negative-electrification powder toner for electrophotography has remarkable characteristics that have not been seen in the prior art toner. These characteristics are such that the toner can produce an image or pattern that can be eliminated by a rubber eraser only, and that the toner has one or more species of solid silicon varnish as a binder and comprises a colorant, an agent controlling electrification, and auxiliary agents, and that the toner is produced by thermally kneading same at a temperature of about 120° C. to 150° C. or kneading in an appropriate solvent, and then milling in a speed mill and finely dividing in an air jet system, followed by classification to give particles of about 5 to 20 micrometers in size.

The materials usable in the inventive toner are solid silicon varnish, electrification controlling agents, colorants, pigments and dyestuffs. Some examples are as follows, but the present invention cannot be limited by these.

The solid silicon varnish used for the inventive toner may be methylsilicon varnish, phenylsilicon varnish, methylphenyl silicon varnish and the like.

The electrification-controlling agents may be a hydrophobic finely-divided silica powder.

The pigments may include carbon black, lamp black, acetylene black, channel black, diamond black, phthalocyanine blue, permanent blue, Fanal TM blue, nigrosine blue, aniline blue, Calconyl TM blue, ultramarine blue, cobalt blue, methylene blue chloride, pigment red, DuPont TM oil red, benzidine yellow, quinoline yellow, chrome yellow, chrome green, phthalocyanine green, malachite green oxalate, rose Bengal, nigrosine dye and the mixture thereof.

The auxiliary agents may be zinc oxide, iron oxide, titanium oxide, aluminium oxide, silicon oxide, talc, quartz, marble and the like.

One formulation used for the present invention is as follows, but should not be interpreted for the limitation of the invention.

EXAMPLE 1

Methyl silicon varnish (solid silicon varnish KR-220 produced by Shinetsu Chemical): 92% by weight
Carbon Black: 8% by weight The mixture of the above formulation was kneaded for three hours at a temperature of about 120° C. in a kneading machine with roller, and then allowed to cool. The resulting mixture was divided by a speed mill, and then finely-divided by a jet mill. The resulting finely-divided powder was sieved to select the particles ranging 10 to 15 millimicrons in size, which was used as the toner for the invention. This toner was mixed into iron carrier particles in the ratio of 4 to 96 parts by weight. The resulting toner was used in a magnet brushing-type copying machine to form an excellent image with high contrast and less blurring. After the toner image transferred on a drawing sheet or a film base was completely fixed, one tried to eliminate the image by using a rubber eraser, and found that the image could easily disappear, and could easily be corrected and added by using pencil or drawing pen to form the good, corrected image.

As described in the foregoing, the copy image formed by the inventive toner can be eliminated by using only a rubber eraser, and then the resulting duplicated images can be readily, safely, and easily eliminated or removed in a short time, so that the efficiency of the office work can be significantly improved.

The image formed on ordinary paper can be corrected without blot, and therefore, the ordinary copy paper can be used as the second original for further copying.

Therefore, an ordinary paper having a surface of the same characteristics as that of a drawing paper and a film base can be used for partial correction of the image thereon by a rubber eraser.

I claim:

1. A negative-electrification powder toner for electrophotography having a softening point in the range of about 90° C. to 110° C., and comprising 100 parts by weight of a binding resin essentially consisting of a solid silicon varnish having a molecular weight in the range of 500 to 4000; 1 to 40 parts by weight of a colorant; and further consisting of an electrification-controlling agent and an auxiliary agent.

2. A toner as claimed in claim 1, wherein the colorant is selected from the group consisting of carbon black, lamp black, acetylene black, channel black and diamond black.

3. A toner as claimed in claim 1, wherein the colorant is selected from the group consisting of phthalocyanine blue, permanent blue, Fanal TM blue, nigrosine blue, aniline blue, Calconyl TM blue, ultramarine blue, cobalt blue and methylene blue chloride.

4. A toner as claimed in claim 1, wherein the colorant is selected from the group consisting of pigment red and Du-Pont TM oil red.

5. A toner as claimed in claim 1, wherein the colorant is selected from the group consisting of benzidine yellow, quinoline yellow, chrome yellow, chrome green, phthalocyanine green, malachite green oxalate, rose Bengal and nigrosine dye.

6. A toner as claimed in claim 1, wherein the binding resin is a silicon varnish selected from the group consisting of methylsilicon varnish, phenylsilicon varnish and methlphenylsilicon varnish.

7. A toner as claimed in claim 1, wherein said electrification-controlling agent is a finely-divided hydrophobic silica powder.

8. A toner as claimed in claim 1, wherein the toner contains further an auxiliary agent such as zinc oxide, iron oxide, titanium oxide, aluminum oxide, silicon oxide, talc, quartz, or marble.

* * * * *